US010394271B2

(12) United States Patent
Zhang et al.

(10) Patent No.: US 10,394,271 B2
(45) Date of Patent: Aug. 27, 2019

(54) FORCE FEEDBACK HANDLE DEVICE WITH A DEGREE-OF-FREEDOM AND WORKING METHOD THEREOF

(71) Applicant: BEIHANG UNIVERSITY, Beijing (CN)

(72) Inventors: Yuru Zhang, Beijing (CN); Dangxiao Wang, Beijing (CN); Hongdong Zhang, Beijing (CN); Jian Song, Beijing (CN); Xiaohan Zhao, Beijing (CN)

(73) Assignee: BEIHANG UNIVERSITY, Beijing (CN)

( * ) Notice: Subject to any disclaimer, the term of this patent is extended or adjusted under 35 U.S.C. 154(b) by 202 days.

(21) Appl. No.: 15/587,288

(22) Filed: May 4, 2017

(65) Prior Publication Data

US 2017/0235327 A1 Aug. 17, 2017

(30) Foreign Application Priority Data

May 4, 2016 (CN) ..... 2016 1 0290764

(51) Int. Cl.
*G05G 5/03* (2008.04)
*G05G 1/04* (2006.01)

(52) U.S. Cl.
CPC ..... *G05G 5/03* (2013.01); *G05G 1/04* (2013.01)

(58) Field of Classification Search
CPC ..... G05G 5/03; G05G 9/04792; G05G 1/04; G05G 1/015; A61B 34/76; A61B 2090/064; F16H 61/24; F16H 21/02; F16H 21/06; F16H 21/12; F16H 21/14; F16H 25/06; F16H 2035/006; F16H 51/00; G01D 11/02; G01D 11/10; G01D 11/16
USPC ..... 74/89.1
See application file for complete search history.

(56) References Cited

U.S. PATENT DOCUMENTS 2,558,103 A * 6/1951 Ruckstahl ..... F16H 51/00 277/500
4,800,721 A * 1/1989 Cemenska ..... E02F 9/2004 244/223
5,068,499 A * 11/1991 Kuratani ..... G05G 9/047 200/6 A
6,109,123 A * 8/2000 Baskis ..... F03G 3/00 74/572.1
6,359,614 B1 * 3/2002 McVicar ..... G05G 1/06 273/148 B
6,892,597 B2 * 5/2005 Tews ..... G05G 9/047 273/148 R
7,148,880 B2 * 12/2006 Magara ..... A61B 6/00 345/161

(Continued)

*Primary Examiner* — Willliam Kelleher
*Assistant Examiner* — T. Scott Fix

(57) ABSTRACT

A force feedback handle device with a degree-of-freedom includes: a driving part (1), a link part (2) and a frame part (3); wherein the driving part (1) and the link part (2) are both installed on a top board (9), and a rotation axis of the link part (2) coincides with a rotation axis of the driving part (1); the driving part (1), the link part (2) and the frame part (3) are fixed and connected by bolts. A working method of the force feedback handle device includes four steps. The force feedback device of the invention has low inertia and high stiffness performance, which improves overall interaction performance of the force feedback device. The structure is simple and a manufacturing cost is low.

2 Claims, 6 Drawing Sheets

(56) References Cited

U.S. PATENT DOCUMENTS

| | | | | |
|---|---|---|---|---|
| 8,371,187 | B2 * | 2/2013 | Payandeh | B25J 13/02 74/469 |
| 2006/0007150 | A1 * | 1/2006 | Onodera | G05G 5/03 345/163 |
| 2015/0318128 | A1 * | 11/2015 | Noh | H01H 25/04 200/4 |

* cited by examiner

FORCE FEEDBACK HANDLE DEVICE WITH A DEGREE-OF-FREEDOM AND WORKING METHOD THEREOF

CROSS REFERENCE OF RELATED APPLICATION

The application claims priority under 35 U.S.C. 119(a-d) to CN 2016/10290764.8, filed May 4, 2016.

BACKGROUND OF THE PRESENT INVENTION

Field of Invention

The present invention relates to a force feedback handle device with a degree-of-freedom and a working method thereof, mainly for dental surgery simulation, virtual reality and virtual assembly, which is capable of measuring positions and providing haptic feels, belonging to tactile/haptic human-computer interaction technology.

Description of Related Arts

With the development of science and technology, especially computer technology, mankind has been able to interact with the computer by visual and auditory, and multimedia and virtual reality world has come. Tactile/haptic combination of human-computer interaction and computer technology will be introduced into the tactile world of virtual reality, so that interaction ways between human, computer and robots will become more abundant. In tactile/haptic human-computer interaction technical field, force feedback devices play an important role. European and American countries have studied force feedback devices deeply, and force feedback equipment manufacturers such as SensAble and Force Dimension have been world leaders. Chinese research on force feedback devices has made a lot of progress and results. Conventional force feedback devices are impedance or admittance force feedback devices. According to the impedance model, the impedance device calculates and obtains a desired output power of the device ends through measuring the actual position or speed of the device end. The admittance device uses a force sensor for measuring the force applied by the user at the end, and uses information about the force and a virtual environment interaction force for calculating positions of virtual objects by the kinematic law as a position output of the device. For the impedance device, because of the feature of position in and force out, the device must be able to reversely drive. In order to feel full freedom at a free space, the device needs to have a sufficient back-drivability, and therefore a mechanical system of the impedance device generally has features such as low inertia, low friction and small gear ratio. The impedance device is good at simulation of free space and small stiffness, but has instability problems during large stiffness rendering. For the admittance device, due to the feature of force in and position out, the mechanical system is generally designed to have a large stiffness, such as a reduction with a large gear ratio, and mechanical parts having a large stiffness. The admittance device is good at simulation of large stiffness environment, but also has instability problems for free space and small stiffness rendering. In order to overcome defects of the impedance and admittance force feedback devices, the present invention provides a force feedback handle device with a degree-of-freedom and a working method thereof.

SUMMARY OF THE PRESENT INVENTION

In order to overcome defects of conventional impedance and admittance force feedback devices, the present invention provides a force feedback handle device with a degree-of-freedom and a working method thereof, wherein the present invention is able to measure end positions and forces applied by the user, so as to provide force feedback and simulate surfaces with large stiffness as well as virtual environments with small friction and small inertia.

Accordingly, in order to accomplish the above objects, the present invention provides a force feedback handle device with a degree-of-freedom, comprising: a driving part (1), a link part (2) and a frame part (3); wherein the driving part (1) and the link part (2) are both installed on a top board (9), and a rotation axis of the link part (2) coincides with a rotation axis of the driving part (1); the driving part (1), the link part (2) and the frame part (3) are fixed and connected by bolts;

wherein the driving part (1) comprises a first encoder (4), a motor (5), a reducer (6), and a dynamic physical constraint (8); wherein the dynamic physical constraint (8) is connected to an output shaft of the reducer (6), the motor (5) is connected to an end of the reducer (6), the first encoder (4) is connected to an end of the motor (5), and the reducer (6) is installed on the top board (9), in such a manner that the driving part (1) is mounted on the top board (9) as a whole; the motor (5) drives the reducer (6) to rotate, so as to drive the dynamic physical constraint (8) to rotate; a rotation angle of the motor (5) is measured by the first encoder (4), and a rotation angle of the dynamic physical constraint (8) is calculated according to a reduction ratio;

wherein in the driving part (1), the first encoder (4) is an optical encoder, a potentiometer or a rotary transformer; the motor (5) is a DC motor; the reducer (6) is a harmonic reducer without backlash; a shape of the dynamic physical constraint (8) comprises two columns, wherein a through-hole is drilled along a column axis direction and cooperates with the output shaft of the reducer (6) for installation; a slot is radically cut on a smaller column of the two columns, and a screw hole is drilled on a side of the smaller column; a larger column of the two columns has a slot, and a width of the slot is wider than the link (11) by a designed value, in such a manner that the link (11) rotates freely within a designed angle; a symmetric axis of the slot vertically intersects with an axis of the through-hole;

wherein the link part (2) comprises a first dowel pin (10), the link (11), a spacer (12), a bearing (13), a link holder (14), a second dowel pin (15), a second encoder (16), a flange (17), a link shaft (18), and a force sensor (19); wherein the bearing (13) is installed on the link holder (14), the link shaft (18) is installed on an inner race of the bearing (13); the link (11) is installed on the link shaft (18); the force sensor (19) is installed on an end of the link (11); a first side of the flange (17) is mounted on a bottom surface of the link holder (14), and a second side of the flange (17) is connected to an end surface of the second encoder (16); the second encoder (16) is mounted on the link holder (14) through the flange (17), and an output shaft of the second encoder (16) is connected to the link shaft (18); the first dowel pin (10) is installed on the top board (9) for determining a relative position of the link holder (14) and the top board (9); the second dowel pin (15) is installed on the link holder (14) and arranged at a rotation limit position of the link (11), in such a manner that when the link (11) reaches a rotation limit, the second dowel pin (15) as a mechanical limit prevents the link (11) from further rotating; the link holder (14) is connected to the top board (9) through bolts, in such a manner that the link part (2) is mounted on the top board (9) as a whole; the link (11) is pushed by a user hand for driving the link shaft (18) to rotate, so as to drive the second encoder (16) to rotate;

wherein a rotation angle of the link (11) is measured by the second encoder (16); the force sensor (19) comprises two 1-dimensional force sensors, so as to detect a user hand force applied on the end of the link (11);

wherein in the link part (2), the first dowel pin (10) is a column pin; the link (11) is a cuboid, and a through-hole is drilled at the end of the link (11), which cooperates with the link shaft (18) for installation; an axis of the through-hole vertically intersects with a symmetric center line of the link (11); the spacer (12) is a ring; the bearing (13) is a deep groove ball bearing; the link holder (14) is a column holder, a first end of the column holder has an end surface, and a bearing hole and a pin shaft hole are drilled on the end surface of the column holder; the bearing (13) cooperates with the bearing hole for installation; the second dowel pin (15) cooperates with the pin hole for installation; the second dowel pin (15) is the column pin; the second encoder (16) is the optical encoder, the potentiometer or the rotary transformer; the flange (17) is U-shaped with two circular holes drilled at two end surfaces of the flange (17); three light holes are respectively arranged around each of the two circular holes; the link shaft (18) is a stepped shaft, a screw hole is drilled on a shaft segment with a smaller diameter, and a light hole is drilled on a shaft segment with a larger diameter; the force sensor (19) is 1-dimensional, an exterior contour of the force sensor (19) is rectangular.

wherein the frame part (3) comprises the top board (9) and two side boards (20); wherein the two side boards (20) are arranged at two sides of the top board (9), and the top board (9) is mounted at top portions of the two side boards (20); the frame part (3) has an inverted U-shape;

wherein the top board (9) is a rectangle, and a rabbet and two averagely distributed light holes are provided at two ends of each narrow edge; a through-hole is drilled at a center of the rectangle, which cooperates with an end surface of the reducer (6) for installation; the side boards (2) are L-shaped with screw holes at top ends and through-holes at bottom ends.

The present invention also provides a working method of a force feedback handle device with a degree-of-freedom, comprising steps of: step 1: driving a link (11) to rotate clockwise or anticlockwise by a force sensor (19) where a user hand is placed; step 2: based on data of a second encoder (16) and the force sensor (19), calculating an angle position of the link (11) and a force applied on an end of the link (11) by the user hand; step 3: providing collision detection, for judging whether the end of the link (11) or the user hand reaches a constraint space; and step 4: if the constraint space is not reached, calculating a target position of a dynamic physical constraint (8) according to an angle of the link (11), and driving the dynamic physical constraint (8) to the target position by controlling a motor (5); meanwhile, keeping a clearance between the dynamic physical constraint (8) and the link (11), in such a manner that a user feels small inertia and small friction during free space; if the constraint space is reached, calculating the target position of the dynamic physical constraint (8) according to the angle of the link (11) and a signal of the force sensor (19), and driving the dynamic physical constraint (8) to the target position by controlling the motor (5); applying a force on the link (11) by the dynamic physical constraint (8), in such a manner that the user feels large stiffness during constraint space movement.

Advantages of the present invention are:

(1) An actuation and the link are decoupled in a mechanical structure, so a reducer with a large gear ratio is used to increase mechanical stiffness of the force feedback device and enhance a control effect of a control system. As a whole, stiffness performance of the force feedback device is improved.

(2) The actuation and the link are decoupled in the mechanical structure, which increases stiffness while causes no side effects on human feeling in a free space. Therefore, the force feedback device has a low inertia performance.

(3) In a constraint motion state, direct contact and collision of the dynamic physical constraint and the link provides a more realistic feeling of a hard surface, enhancing interaction of the force feedback device.

(4) The dynamic physical constraint can apply a bidirectional effect to the link, in such a manner that the present invention can be applied to a multi-degree-of-freedom force feedback device, widening application expansibility.

(5) Incremental encoder measurement of a link angle and a dynamic physical constraint angle reduces costs.

These and other objectives, features, and advantages of the present invention will become apparent from the following detailed description, the accompanying drawings, and the appended claims.

Figure 1:
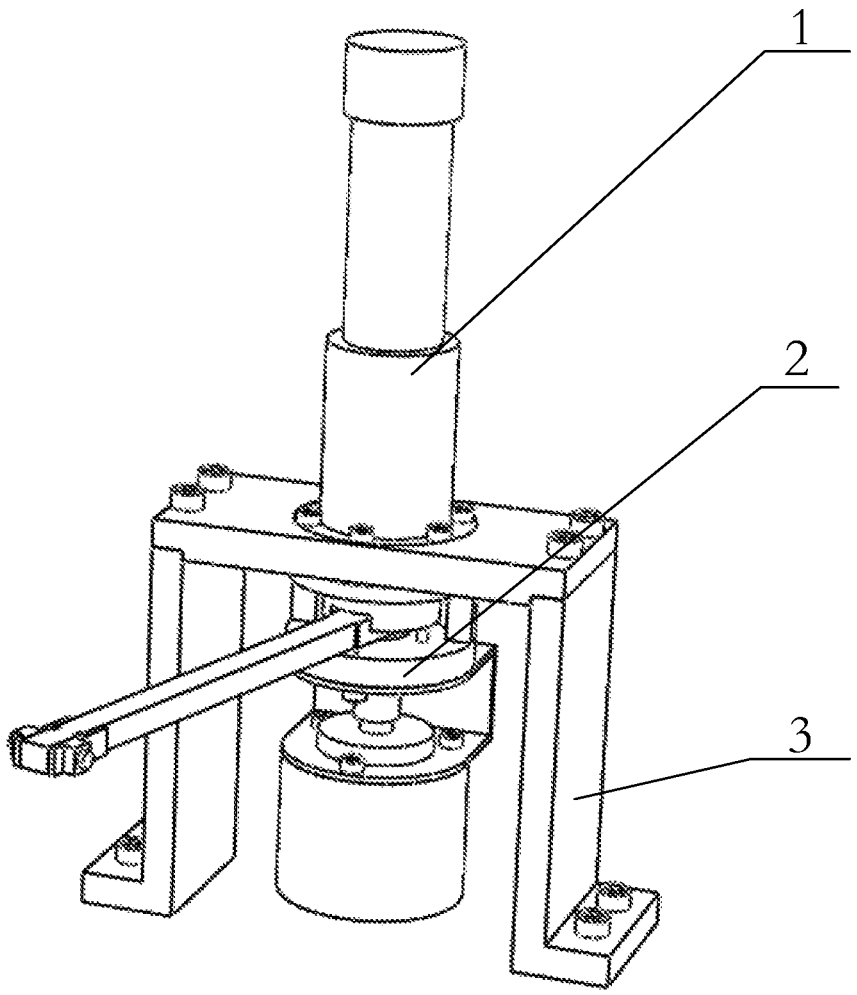
FIG. 1 is a perspective view of a force feedback handle device according to the present invention.

Element reference: driving part (1), link part (2), frame part (3), first encoder (4), motor (5), reducer (6), dynamic physical constraint bolt (7), dynamic physical constraint (8), top board (9), first dowel pin (10), link (11), spacer (12), bearing (13), link holder (14), second dowel pin (15), second encoder (16), flange (17), link shaft (18), force sensor (19), side board (20), frame bolt (21).

DETAILED DESCRIPTION OF THE PREFERRED EMBODIMENT

Referring to the drawings, an embodiment of the present invention is illustrated in detail.

Referring to FIG. 1, the present invention provides a force feedback handle device with a degree-of-freedom, comprising: a driving part 1, a link part 2 and a frame part 3; wherein the driving part 1 and the link part 2 are both installed on a top board 9, and a rotation axis of the link part 2 coincides with a rotation axis of the driving part 1; wherein a link holder 14 and the top board 9 are connected through a shaft hole for ensuring assemble accuracy, so as to ensure coaxiality of the rotation axis of the link part 2 and the rotation axis of the driving part 1; the driving part 1, the link part 2 and the frame part 3 are fixed and connected by bolts.

Figure 2:
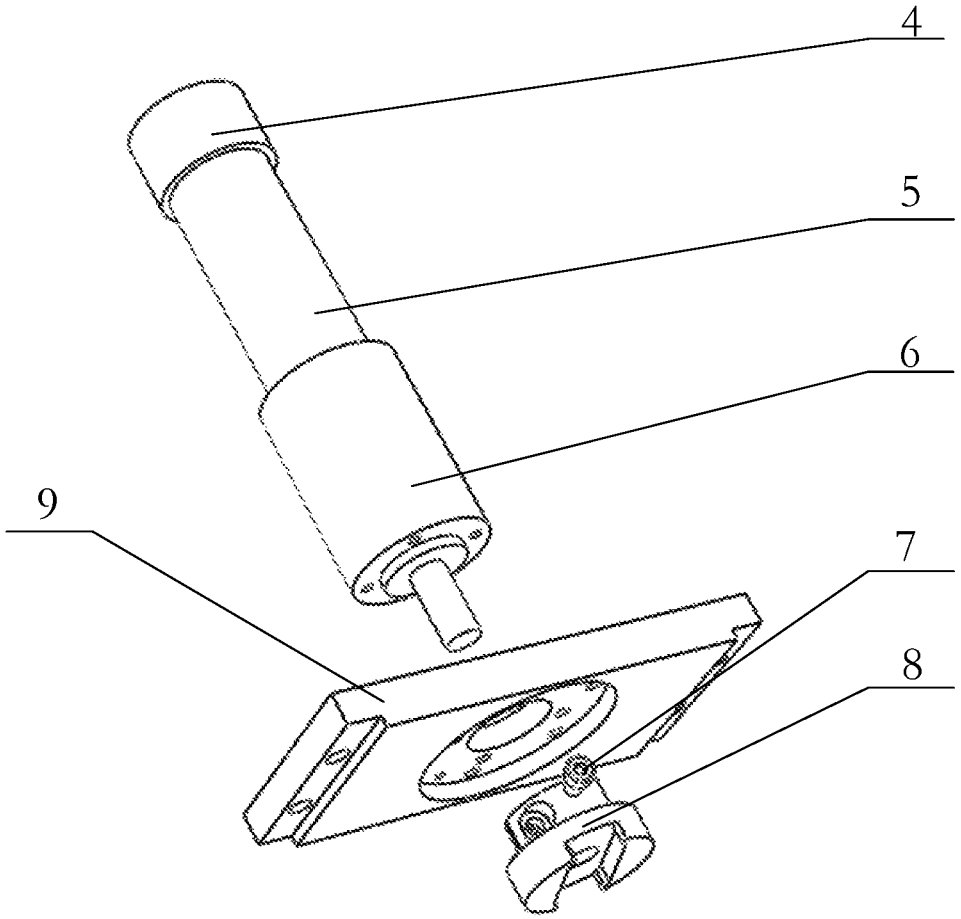
FIG. 2 is an exploded view of a driving part of the force feedback handle device according to the present invention.
Figure 3:
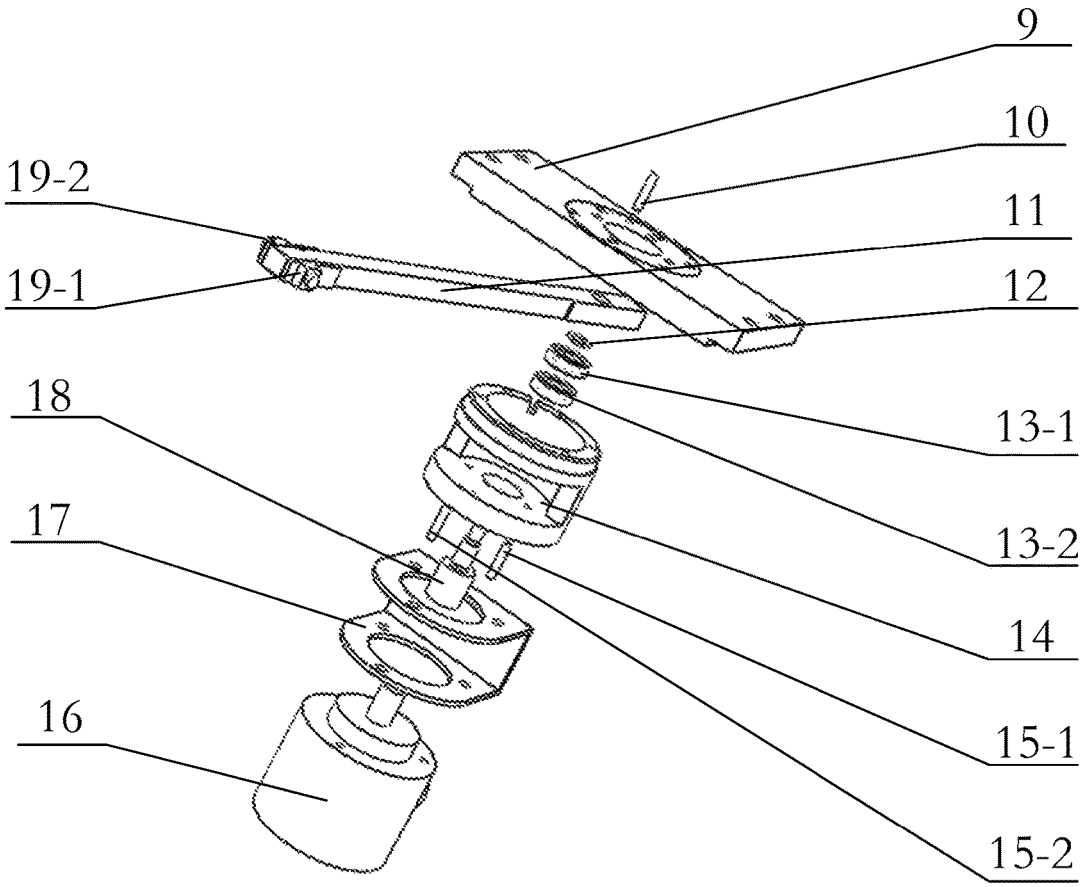
FIG. 3 is an exploded view of a link part of the force feedback handle device according to the present invention.

Referring to FIG. 2, the driving part 1 comprises a first encoder 4, a motor 5, a reducer 6, and a dynamic physical constraint 8; wherein the dynamic physical constraint 8 is mounted on an output shaft of the reducer 6, the motor 5 is connected to an end of the reducer 6, the first encoder 4 is connected to an end of the motor 5, and the reducer 6 is installed on the top board 9 by bolts, in such a manner that the driving part 1 is mounted on the top board 9 as a whole; the motor 5 drives the reducer 6 to rotate, so as to drive the dynamic physical constraint 8 to rotate; a rotation angle of the motor 5 is measured by the first encoder 4, and a rotation angle of the dynamic physical constraint 8 is calculated according to a reduction ratio. The first encoder 4 is an optical encoder, a potentiometer or a rotary transformer; the motor 5 is a DC motor; the reducer 6 is a harmonic reducer without backlash; a shape of the dynamic physical constraint 8 comprises two columns, wherein a through-hole is drilled along a column axis direction and cooperates with the output shaft of the reducer 6 for installation; a slot is radically cut on a smaller column of the two columns, and a screw hole is drilled on a side of the smaller column; a larger column of the two columns has a slot, and a width of the slot is wider than the link 11 by a designed value, in such a manner that the link 11 rotates freely within a certain angle; a symmetric axis of the slot vertically intersects with an axis of the column through-hole;

Referring to FIG. 3, an exploded view of the link part 2 of the force feedback handle device according to the present invention is shown, wherein the link part 2 comprises a first dowel pin 10, the link 11, a spacer 12, a bearing 13, a link holder 14, a second dowel pin 15, a second encoder 16, a flange 17, a link shaft 18, and a force sensor 19; wherein the bearing 13 is installed on the link holder 14, the link shaft 18 is installed on an inner race of the bearing 13; the link 11 is installed on the link shaft 18; the force sensor 19 is installed on an end of the link 11 and is arranged at two sides of the link 19, wherein a direction of a force detected by the force sensor 19 is identical to an instantaneous movement direction of the end of the link 11; a first side of the flange 17 is mounted on a bottom surface of the link holder 14 by bolts, and a second side of the flange 17 is connected to an end surface of the second encoder 16; the second encoder 16 is mounted on the link holder 14 through the flange 17, and an output shaft of the second encoder 16 is connected to the link shaft 18; the first dowel pin 10 is installed on the top board 9 for determining a relative position of the link holder 14 and the top board 9; the second dowel pin 15 is installed on the link holder 14 and arranged at a rotation limit position of the link 11, in such a manner that when the link 11 reaches a rotation limit, the second dowel pin 15 as a mechanical limit prevents the link 11 from further rotating; the link holder 14 is mounted to the top board 9 through bolts by shaft hole cooperating, in such a manner that the link part 2 is mounted on the top board 9 as a whole; the link 11 is pushed by a user hand for driving the link shaft 18 to rotate, so as to drive the second encoder 16 to rotate; wherein a rotation angle of the link 11 is measured by the second encoder 16. The first dowel pin 10 is a column pin; the link 11 is a cuboid, and a through-hole is drilled at the end of the link 11, which cooperates with the link shaft 18 for installation; an axis of the link through-hole vertically intersects with a symmetric center line of the link 11; the spacer 12 is a ring; the bearing 13 is a deep groove ball bearing; the link holder 14 is a column holder, a first end of the column holder has an end surface, and a bearing hole and a pin shaft hole are drilled on the end surface of the column holder; the bearing 13 cooperates with the bearing hole for installation; the second dowel pin 15 cooperates with the pin shaft hole for installation; a second end of the column holder has an opining which satisfies a rotation range; the second dowel pin 15 is the column pin; the second encoder 16 is the optical encoder, the potentiometer or the rotary transformer; the flange 17 is U-shaped with two circular holes drilled at two end surfaces of the flange 17; three light holes are respectively arranged around each of the two circular holes; the link shaft 18 is a stepped shaft, a screw hole is drilled on a shaft segment with a smaller diameter, and a light hole is drilled on a shaft segment with a larger diameter; the force sensor 19 is 1-dimensional, an exterior contour of the force sensor 19 is rectangular.

Figure 4:
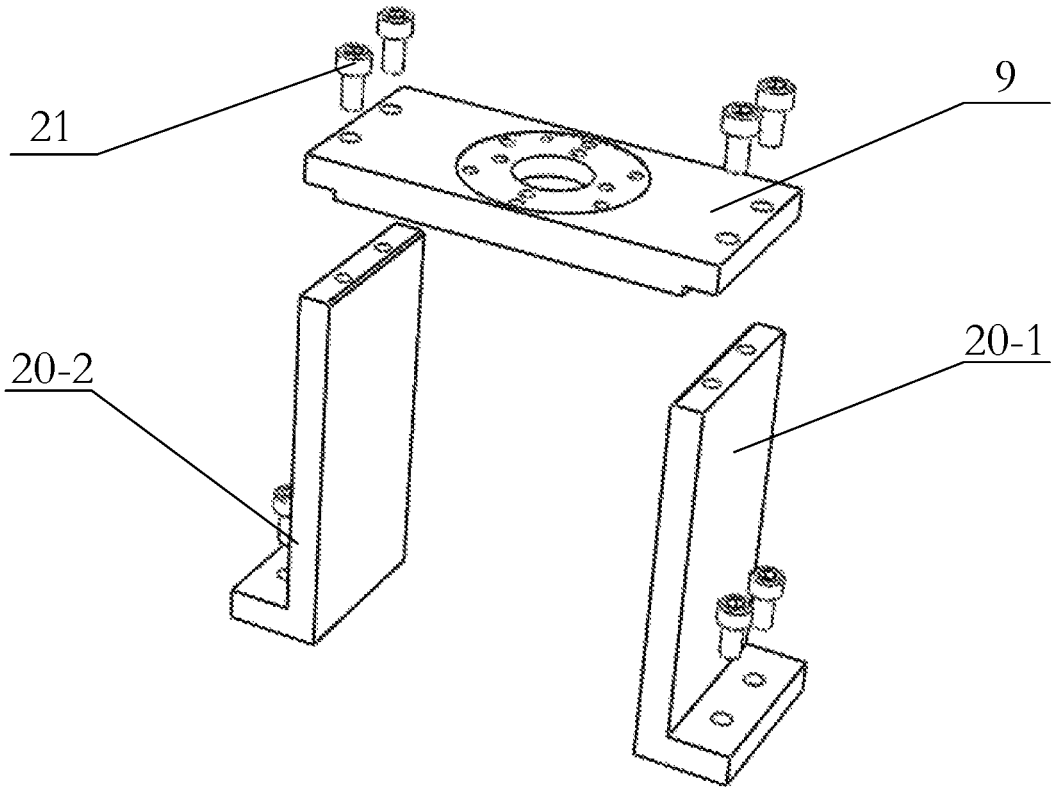
FIG. 4 is an exploded view of a frame part of the force feedback handle device according to the present invention.

FIG. 4 is an exploded view of the frame part 3 of the force feedback handle device according to the present invention, wherein the frame part 3 comprises the top board 9 and two side boards 20; wherein the two side boards 20 are arranged at two sides of the top board 9, and the top board 9 is mounted at top portions of the two side boards 20; the frame part 3 has an inverted U-shape. The top board 9 is a rectangle, and a rabbet and two averagely distributed light holes are provided at two ends of each narrow edge; a through-hole is drilled at a center of the rectangle, which cooperates with an end surface of the reducer 6 for installation; the side boards 20 are L-shaped with screw holes at top ends and through-holes at bottom ends.

Figure 5:
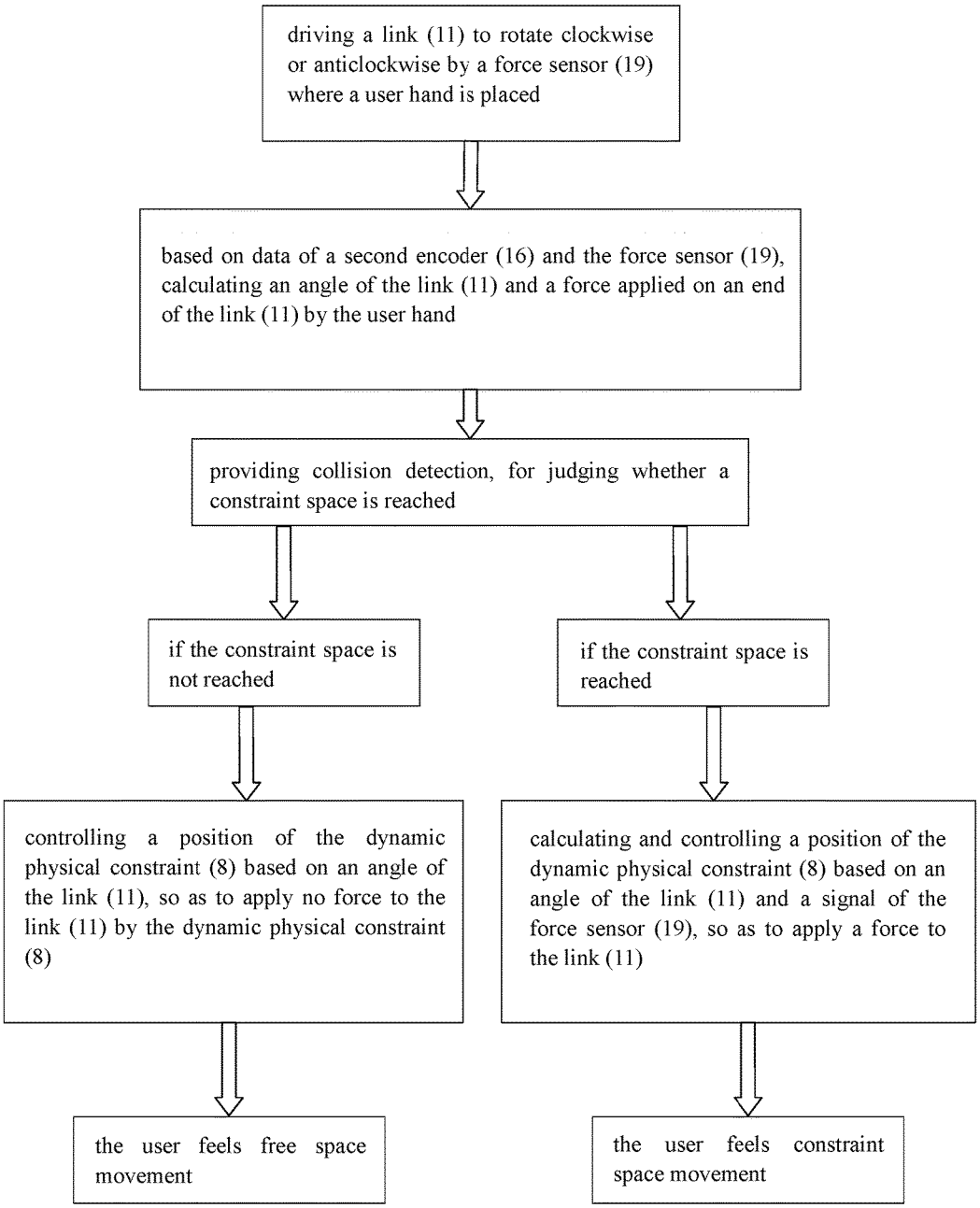
FIG. 5 is a flow chart of a working method of the force feedback handle device according to the present invention.

Referring to FIG. 5, a working method of a force feedback handle device with a degree-of-freedom is shown, comprising steps of: step 1: driving a link 11 to rotate clockwise or anticlockwise by a force sensor 19 where a user hand is placed; step 2: based on data of a second encoder 16 and the force sensor 19, calculating an angle of the link 11 and a force applied on an end of the link 11 by the user hand; step 3: providing collision detection, for judging whether the end of the link 11 reaches a constraint space; and step 4: if the constraint space is not reached, calculating a target position of a dynamic physical constraint 8 according to an angle of the link 11, and driving the dynamic physical constraint 8 to the target position by controlling a motor 5; meanwhile, keeping a clearance between the dynamic physical constraint 8 and the link 11, in such a manner that a user feels small inertia and small friction during free space movement; if the constraint space is reached, calculating the target position of the dynamic physical constraint 8 according to the angle of the link 11 and a signal of the force sensor 19, and driving the dynamic physical constraint 8 to the target position by controlling the motor 5; applying a force on the link 11 by the dynamic physical constraint 8, in such a manner that the user feels large stiffness during constraint space movement.

Figure 6:
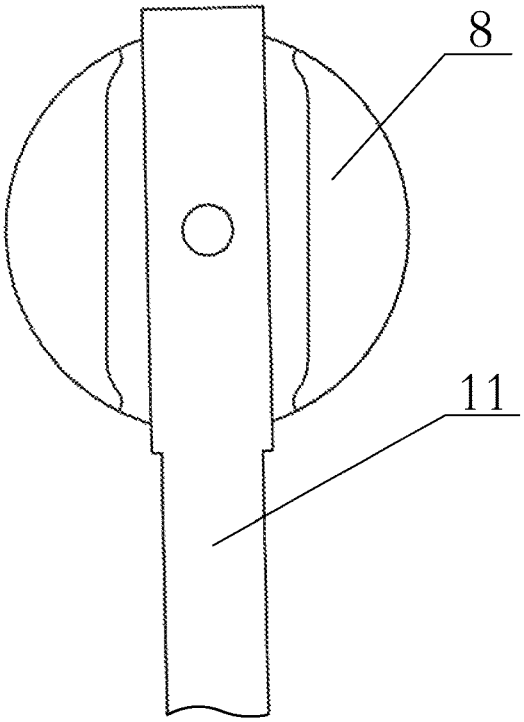
FIG. 6 is a sketch view of a position relation of a dynamic physical constraint and a link in a free space according to the present invention.

FIG. 6 is a sketch view of a position relation of the dynamic physical constraint 8 and the link 11 in a free space according to the present invention, wherein the dynamic physical constraint 8 has a slot, and a width of the slot is wider than the link 11 by a designed value, in such a manner that when the dynamic physical constraint 8 remains, the link 11 is still able to rotates freely within a designed angle. The dynamic physical constraint 8 with the slot is able to provide a bidirectional constraint to the link 11. According to the working method of the present invention, when moving in the free space, the dynamic physical constraint 8 always keeps a designed angle with the link 11, in such a manner that a symmetric center line of the slot of the dynamic physical constraint 8 coincides with the symmetric center line of the link 11. As a result, there is no interaction between the dynamic physical constraint 8 and the link 11, and the user can push the link 11 freely.

Figure 7:
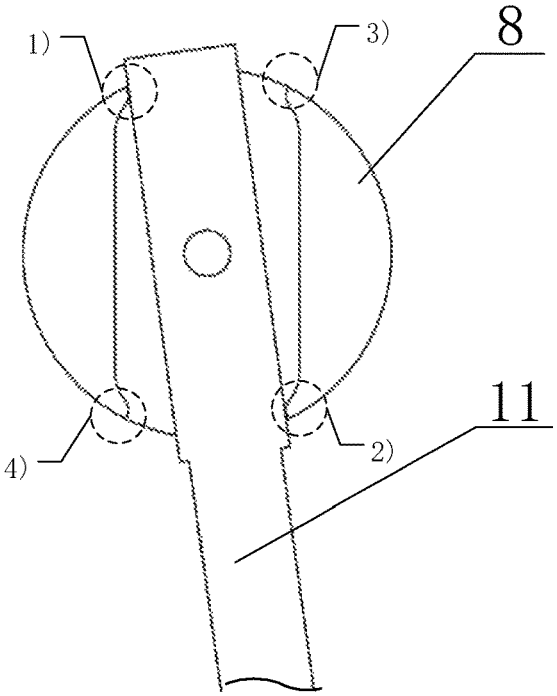
FIG. 7 is a sketch view of a position relation of the dynamic physical constraint and the link in a constraint space according to the present invention.

FIG. 7 is a sketch view of a position relation of the dynamic physical constraint 8 and the link 11 in a constraint space according to the present invention, wherein according to the working method of the present invention, when in the constraint space, the target position of the dynamic physical constraint 8 is calculated, and then the dynamic physical constraint 8 is moved to the target position by controlling the motor 5 and the reducer 6. When the link 11 rotates anticlockwise, the dynamic physical constraint 8 contacts at a position 1) and a position 2) at the same time. When the link 11 rotates clockwise, the dynamic physical constraint 8 contacts at a position 3) and a position 4) at the same time. Therefore, the link 11 bears an anticlockwise force or a clockwise force, and the user feels a feedback force. The link 11 bears a pair of forces with equal values and inverted directions at the position 1) and the position 2), or the position 3 and the position 4), so a counterforce on the output shaft of the reducer 6 only causes an axial moment and has no radical moment, which removes a radical force impact on structure stiffness and increases system stiffness.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A force feedback handle device with a degree-of-freedom, comprising: a driving part (1), a link part (2) and a frame part (3); wherein the driving part (1) and the link part (2) are both installed on a top board (9), and a rotation axis of the link part (2) coincides with a rotation axis of the driving part (1); the driving part (1), the link part (2) and the frame part (3) are fixed and connected by bolts;

wherein the driving part (1) comprises a first encoder (4), a motor (5), a reducer (6), and a dynamic physical constraint (8); wherein the dynamic physical constraint (8) is connected to an output shaft of the reducer (6), the motor (5) is connected to an end of the reducer (6), the first encoder (4) is connected to an end of the motor (5), and the reducer (6) is installed on the top board (9), in such a manner that the driving part (1) is mounted on the top board (9) as a whole; the motor (5) drives the reducer (6) to rotate, so as to drive the dynamic physical constraint (8) to rotate; a rotation angle of the motor (5) is measured by the first encoder (4), and a rotation angle of the dynamic physical constraint (8) is calculated according to a reduction ratio;

wherein in the driving part (1), the first encoder (4) is an optical encoder, a potentiometer or a rotary transformer; the motor (5) is a DC motor; the reducer (6) is a harmonic reducer without backlash; a shape of the dynamic physical constraint (8) comprises two columns, wherein a through-hole is drilled along a column axis direction and cooperates with the output shaft of the reducer (6) for installation; a slot is radically cut on a smaller column of the two columns, and a screw hole is drilled on a side of the smaller column; a larger column of the two columns has a slot, and a width of the slot is wider than the link (11) by a predetermined value, in such a manner that the link (11) rotates freely within a predetermined angle; a symmetric axis of the slot vertically intersects with an axis of the through-hole;

wherein the link part (2) comprises a first dowel pin (10), the link (11), a spacer (12), a bearing (13), a link holder (14), a second dowel pin (15), a second encoder (16), a flange (17), a link shaft (18), and a force sensor (19); wherein the bearing (13) is installed on the link holder (14), the link shaft (18) is installed on an inner race of the bearing (13); the link (11) is installed on the link shaft (18); the force sensor (19) is installed on an end of the link (11); a first side of the flange (17) is mounted on a bottom surface of the link holder (14), and a second side of the flange (17) is connected to an end surface of the second encoder (16); the second encoder (16) is mounted on the link holder (14) through the flange (17), and an output shaft of the second encoder (16) is connected to the link shaft (18); the first dowel pin (10) is installed on the top board (9) for determining a relative position of the link holder (14) and the top board (9); the second dowel pin (15) is installed on the link holder (14) and arranged at a rotation limit position of the link (11), in such a manner that when the link (11) reaches a rotation limit, the second dowel pin (15) as a mechanical limit prevents the link (11) from further rotating; the link holder (14) is connected to the top board (9) through bolts, in such a manner that the link part (2) is mounted on the top board (9) as a whole; the link (11) is pushed by a user hand for driving the link shaft (18) to rotate, so as to drive the second encoder (16) to rotate; wherein a rotation angle of the link (11) is measured by the second encoder (16); the force sensor (19) comprises two 1-dimensional force sensors, so as to detect a user hand force applied on the end of the link (11);

wherein in the link part (2), the first dowel pin (10) is a column pin; the link (11) is a cuboid, and a through-hole is drilled at the end of the link (11), which cooperates with the link shaft (18) for installation; an axis of the through-hole vertically intersects with a symmetric center line of the link (11); the spacer (12) is a ring; the bearing (13) is a deep groove ball bearing; the link holder (14) is a column holder, a first end of the column holder has an end surface, and a bearing hole and a pin shaft hole are drilled on the end surface of the column holder; the bearing (13) cooperates with the bearing hole for installation; the second dowel pin (15) cooperates with the pin hole for installation; the second dowel pin (15) is the column pin; the second encoder (16) is the optical encoder, the potentiometer or the rotary transformer; the flange (17) is U-shaped with two circular holes drilled at two end surfaces of the flange (17); three light holes are respectively arranged around each of the two circular holes; the link shaft (18) is a stepped shaft, a screw hole is drilled on a shaft segment with a smaller diameter, and a light hole is drilled on a shaft segment with a larger diameter; the force sensor (19) is 1-dimensional, an exterior contour of the force sensor (19) is rectangular;

wherein the frame part (3) comprises the top board (9) and two side boards (20); wherein the two side boards (20) are arranged at two sides of the top board (9), and the top board (9) is mounted at top portions of the two side boards (20); the frame part (3) has an inverted U-shape;

wherein the top board (9) is a rectangle, and a rabbet and two evenly distributed light holes are provided at two ends of each narrow edge; a through-hole is drilled at a center of the rectangle, which cooperates with an end surface of the reducer (6) for installation; the side boards (2) are L-shaped with screw holes at top ends and through-holes at bottom ends.

2. A working method of a force feedback handle device with a degree-of-freedom as recited in claim 1, comprising steps of: step 1: driving a link (11) to rotate clockwise or anticlockwise by a force sensor (19) where a user hand is placed; step 2: based on data of a second encoder (16) and the force sensor (19), calculating an angle position of the link (11) and a force applied on an end of the link (11) by the user hand; step 3: providing collision detection, for determining whether the end of the link (11) or the user hand reaches a constraint space; and step 4: if the constraint space is not reached, calculating a target position of a dynamic physical constraint (8) according to an angle of the link (11), and driving the dynamic physical constraint (8) to the target position by controlling a motor (5); simultaneously, keeping a clearance between the dynamic physical constraint (8) and the link (11), in such a manner that the link has a smaller value of stiffness during free space; if the constraint space is reached, calculating the target position of the dynamic physical constraint (8) according to the angle of the link (11) and a signal of the force sensor (19), and driving the dynamic physical constraint (8) to the target position by controlling the motor (5); applying a force on the link (11) by the dynamic physical constraint (8), in such a manner that the link has a larger value of stiffness during constraint space movement.

* * * * *